US010741934B2

(12) United States Patent
Lybrand

(10) Patent No.: US 10,741,934 B2
(45) Date of Patent: Aug. 11, 2020

(54) ROTARY IDC JUNCTION CONNECTOR

(71) Applicant: AVX Corporation, Fountain Inn, SC (US)

(72) Inventor: Brent Lybrand, Fountain Inn, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/441,567

(22) Filed: Jun. 14, 2019

(65) Prior Publication Data

US 2019/0393622 A1 Dec. 26, 2019

Related U.S. Application Data

(60) Provisional application No. 62/687,968, filed on Jun. 21, 2018.

(51) Int. Cl.
*H01R 4/2412* (2018.01)
*H01R 4/2425* (2018.01)

(52) U.S. Cl.
CPC ..... *H01R 4/2412* (2013.01); *H01R 4/2425* (2013.01)

(58) Field of Classification Search
CPC .. H01R 4/2412; H01R 4/2425; H01R 4/2429; H01R 4/2433; H01R 4/2437
See application file for complete search history.

(56) References Cited

U.S. PATENT DOCUMENTS 3,980,380 A * 9/1976 Cieniawa ..... H01R 4/2429 439/404
4,157,208 A * 6/1979 Roberts ..... H01R 43/015 439/204
5,254,015 A * 10/1993 Robertson ..... H01R 4/2441 439/410
5,910,643 A 6/1999 Laine et al.
(Continued)

FOREIGN PATENT DOCUMENTS

CN 103119787 A 5/2013
WO WO-98/48490 A1 1/1900
WO WO-98/48490 A1 10/1998

OTHER PUBLICATIONS

International Search Report and Written Opinion in PCT/IB2019/055061 dated Nov. 25, 2019 (11 pages).

*Primary Examiner* — Oscar C Jimenez
(74) *Attorney, Agent, or Firm* — Foley & Lardner LLP

(57) ABSTRACT

This disclosure provides a method and apparatus for connecting and disconnecting various electrical components. More specifically, an apparatus that includes an electrical contact and an insulated housing. In an embodiment, the electrical contact includes a first insulation displacement contact, a second insulation displacement contact, and a motion-force portion. The motion-force portion is configured to allow the electrical contact to be actuated around a central axis and relative to the insulated housing. The first and second insulation displacement contacts allow for the electrical contact to create an electrical and mechanical
(Continued)

connection between respective wires when the electrical contact is rotated. A rotary insulation displacement contact (IDC) junction connector allows for two wires to be reliably and safely connected in environments where space is limited.

18 Claims, 4 Drawing Sheets

(56) References Cited

U.S. PATENT DOCUMENTS

| | | | | |
|---|---|---|---|---|
| 6,299,474 | B2 * | 10/2001 | Daoud ..... | H01R 4/2433<br>439/395 |
| 2005/0227529 | A1 | 10/2005 | Mrakovich et al. | |
| 2015/0280331 | A1 | 10/2015 | Acera | |

* cited by examiner

ROTARY IDC JUNCTION CONNECTOR

CROSS-REFERENCE TO RELATED APPLICATIONS

This application claims priority to U.S. Provisional Patent Application No. 62/687,968, filed Jun. 21, 2018, the entire disclosure of which is incorporated herein by reference in its entirety, for any and all purposes.

FIELD

The present application relates generally to the field of electrical connectors, and more particularly to a type of connector used to form an electrical connection between multiple electrical components, including for example insulated wires.

BACKGROUND

The following description is provided to assist the understanding of the reader. None of the information provided or references cited are admitted to be prior art.

Various types of connectors are used for forming connections between an insulated wire and any manner of electronic or electrical component. These connectors are typically available as sockets, plugs, and shrouded headers in a vast range of sizes, pitches, and plating options. Traditionally, for two wires to be connected together, a user must strip the first and second wires, twist the two ends together, and then secure them to one other. Alternatively, the user must strip the first and second wires and solder them together or to a common electrically conductive terminal. This process can be tedious, inefficient, and undesirable. Furthermore, a wire-to-wire connection that may fall apart or short out unexpectedly could be hazardous or cause equipment failure. Moreover, traditional insulation displacement connectors require tabletop presses and fixtures to manage the high amount of force involved. However, many applications do not have the luxury of available space. Thus, a quick, efficient, and reliable means of connecting a plurality of wires in any space is needed.

SUMMARY

The systems, methods and devices of this disclosure each have several innovative aspects, no single one of which is solely responsible for the desirable attributes disclosed herein.

A rotary insulation displacement contact (IDC) junction connector is disclosed. The rotary insulation displacement contact connector includes an insulated housing and an electrical contact. The insulated housing includes at least one wire opening and the electrical contact includes at least one insulation displacement contact and a motion-force portion. Further, at least a portion of the at least one insulation displacement contact is aligned with the at least one wire opening. The motion-force portion is configured to facilitate rotation of the electrical axis around a central axis and relative to the insulated housing. In an embodiment, the at least one wire opening extends all the way through the insulated housing. The at least one insulation displacement contact may be an elongated aperture that is curved. The curved, elongated aperture may have a center of curvature at the central axis. The at least one insulation displacement contact includes a narrow portion, a wide portion, and at least one blade. The wide portion may have a width equal to or greater than a diameter of the at least one wire opening. The narrow portion may have a portion where the width is smaller than a diameter of the at least one wire opening.

The motion-force portion may be an opening (e.g., tool aperture) centered on the central axis shaped to receive a driver bit. The driver bit may engage with the motion-force portion and rotate the electrical contact when the driver bit is rotated. Furthermore, the electrical contact may also include a plurality of notches on an outer edge of the electrical contact, and the insulated housing may also include a plurality of projections. In an embodiment, each of the plurality of projections is configured to create a frictional force between one of the plurality of notches. More specifically, the electrical contact may be in a first position relative to the insulated housing. The first position may be where each of the plurality of projections are engaged (e.g., meshed) with one of the plurality of notches such that at least one wire opening aligned with the wide portion of the at least one insulation displacement contact. Further, the electrical contact may be in a second position (e.g., after rotation) relative to the insulated housing. The second position may be where each of the plurality of projections engage with a different one of the plurality of notches and where the at least one wire opening is aligned with the narrow portion of the at least one insulation displacement contact. These pre-determined positions improve the usability and reliability of the connector.

In an operation of use, the rotary insulation displacement contact junction connector electrically and mechanically connects a first wire and second wire. Specifically, in an operation, the first wire is inserted into a first wire opening of an insulated housing and through a wide portion of a first insulation displacement contact of an electrical contact. Additionally, the second wire is inserted into a second wire opening of the insulated housing and through a second wide portion of a second insulation displacement contact of the electrical contact. A tool or other device may then be engaged with the electrical contact. The electrical contact is then rotated about a central axis to form an electrical connection between the first and second wires and the electrical contact. Specifically, the first wire and the second wire are held via wire openings in a constant position relative to the insulated housing while the electrical contact is rotated within and relative to the insulated housing. The rotation of the electrical contact relative to the insulated housing causes the first insulation displacement contact to displace insulation of the first wire and an electrical and mechanical connection to be created between a conductive core of the first wire and the electrical contact. Similarly, the rotation of the electrical contact also causes the second insulation displacement contact to displace insulation of the second wire and an electrical and mechanical connection to be created between a conductive core of the second wire and the electrical contact.

The rotary insulation displacement contact (IDC) junction connector is not limited by any number of wire positions, wire openings, or insulation displacement contacts. Particular embodiments of insulation displacement connectors are described in greater detail below by reference to the examples illustrated in the various drawings.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Disclosed herein is a rotary insulation displacement contact (IDC) junction connector. The rotary IDC junction connector includes an insulated housing and an electrical contact. The insulated housing includes a base and a cap. The electrical contact includes a motion-force portion and at least one insulation displacement contact (IDC). Such a rotary IDC junction connector may be used to efficiently and reliably mechanically and electrically couple one or more electrical components (e.g., insulated wires, contacts, etc.) to each other. Specifically, rotary IDC junction connector allows for an efficient and rapid creation of an electrical and mechanical connection between the conductive element of an insulated wire (or other electrical component) and an electrical contact of the connector. Further, the motion-force portion allows for the electrical contact to be rotatable relative the insulated housing. The motion-force portion allows for the at least one IDC to displace the insulation of the insulated wire and create a mechanical and electrical connection between the wire and the electrical contact within small confines because rotary motion (as opposed to vertical or horizontal linear motion) is used to create the connection. In other words, the rotary IDC junction connector does not require a table-top force for the IDC to be engage with the insulated wire. Thus, the rotary IDC junction connector can be used in applications where space is limited. Furthermore, the electrical contact may include a plurality of insulation displacement contacts (IDC) that allow for a plurality of insulated wires be mechanically and electrically connected to the electrical contact (and thereby electrically connected together).

Various embodiments of a rotary IDC junction connector are illustrated throughout FIGS. 1 through 4. The rotary IDC junction connector disclosed in these figures is configured to electrically and mechanically connect a conductive core of one, two, three, four, five or more insulated wires with an electrical contact. It should be appreciated that the rotary IDC junction connector disclosed herein are not limited by a maximum number of wire positions, electrical contacts, shunts, or types of connections that couple each component together.

Figure 1B:
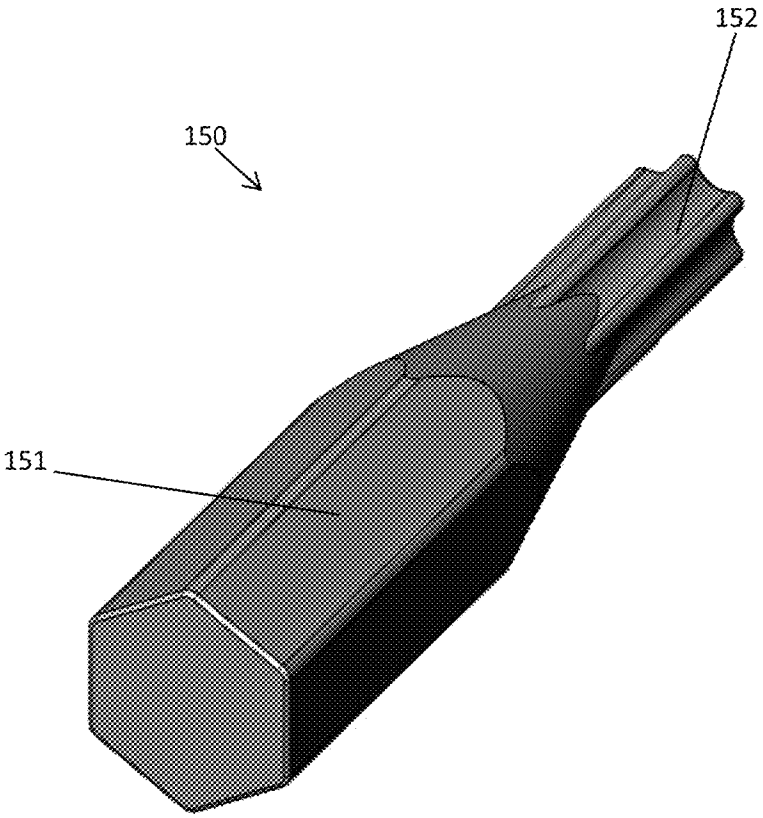
FIG. 1*b* depicts an isometric view of a driver bit in accordance with an illustrative embodiment.
Figure 1A:
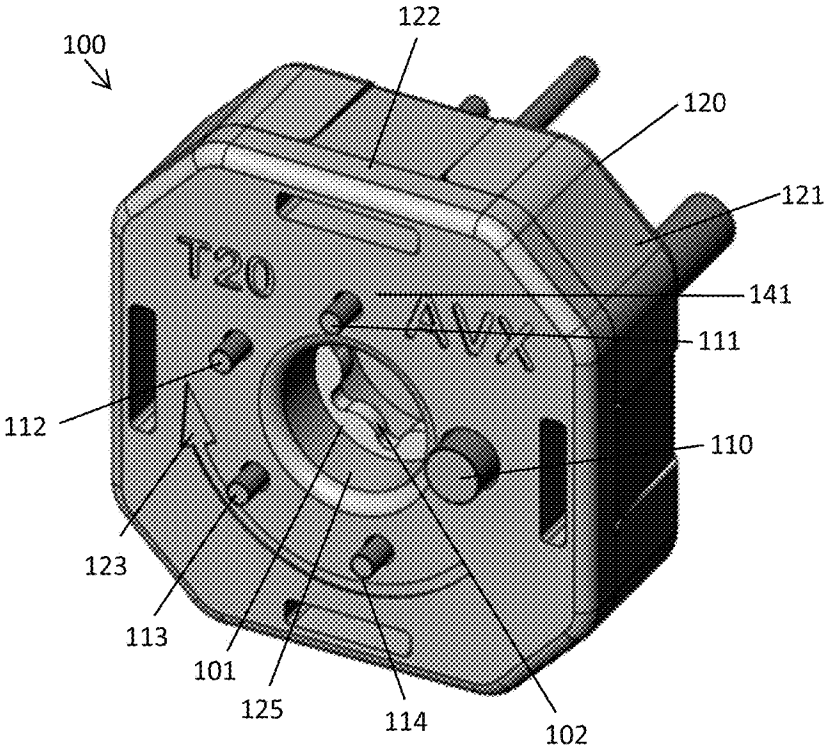
FIG. 1*a* depicts an isometric view of a rotary insulation displacement contact (IDC) junction connector with wires in accordance with an illustrative embodiment.

FIG. 1*a* depicts an isometric view of a rotary insulation displacement contact (IDC) junction connector 100 with wires 110, 111, 112, 113, and 114 in accordance with an illustrative embodiment. FIG. 1*b* depicts an isometric view of a driver bit 150 in accordance with an illustrative embodiment. The rotary IDC junction connector 100 includes an insulated housing 120 and an electrical contact 101. The insulated housing 120 includes a base 121 and a cap 122. The insulated housing 120 includes at least one wire opening 141. In an embodiment, the insulated housing 120 includes one, two, three, four, five, six or more wire openings 141. The at least one wire opening 141 extends entirely through the insulated housing 120. In alternative embodiments, the at least one wire opening 141 may only extend through a portion of the insulated housing 120. The wires 110, 111, 112, 113, and 114 extend through respective wire openings 141 and extend through an opening (e.g., a wide portion of an insulation displacement contact) in the electrical contact 101. That is, at least a portion each insulation displacement contact is aligned with a corresponding wire opening of the insulated housing 120.

The insulated housing 120 may also include a tool recess 125. The tool recess 125 exposes a motion-force portion 102 (e.g., a tool receiving portion) of the electrical contact 101 that can be selectively engaged via the driver bit 150 or other tool that allows for the mechanical rotation of the electrical contact 101 relative to the insulated housing 120. The motion-force portion 102 is configured to receive an external force (e.g., from a tool or other source) to cause selective rotation or movement of the electrical contact 101. In an example embodiment, the driver bit has a drive portion 151 and a head portion 152. The drive portion 151 may be mechanically secured to a handheld drill, an electrical drill, or other similar device. The head portion 152 may be any shape that allows the head portion 152 to mechanically secure to the motion-force portion 102 in order to rotate the electrical contact 101. In alternative embodiments, the insulated housing 120 may include a permanent fixture that allows for the mechanical rotation of the electrical contact 101. In yet alternative embodiments, the motion-force portion 102 may extend outward from the insulated housing 120 in the form of a knob or other outward extending portion such that the portion can be gripped and mechanically rotated by a user and thereby rotating the electrical contact 101 around a central axis 190 and relative to the insulated housing 120. In an embodiment, the motion-force portion 102 is shaped such that the electrical contact 101 may receive a Torx® type driver head. In alternative embodiments, the motion-force portion 102 may be shaped to receive any shape that corresponds to a device that can be used to mechanically rotate the electrical contact 101.

The insulated housing 120 may also include a turn indicator 123. The turn indicator 123 indicates the rotary direction that the electrical contact 101 is to be turned in order for insulation displacement contacts (IDC) of the electrical contact 101 to displace the insulation of respective wires 110, 111, 112, 113, and 114 and create a mechanical and electrical connection between the conductive core of the wires 110, 111, 112, 113, and 114 and the electrical contact 101. In alternative embodiments, the turn indicator 123 may on any side of the insulated housing 120, or the turn indicator 123 may be on an exposed portion of the electrical contact 101.

Figure 2B:
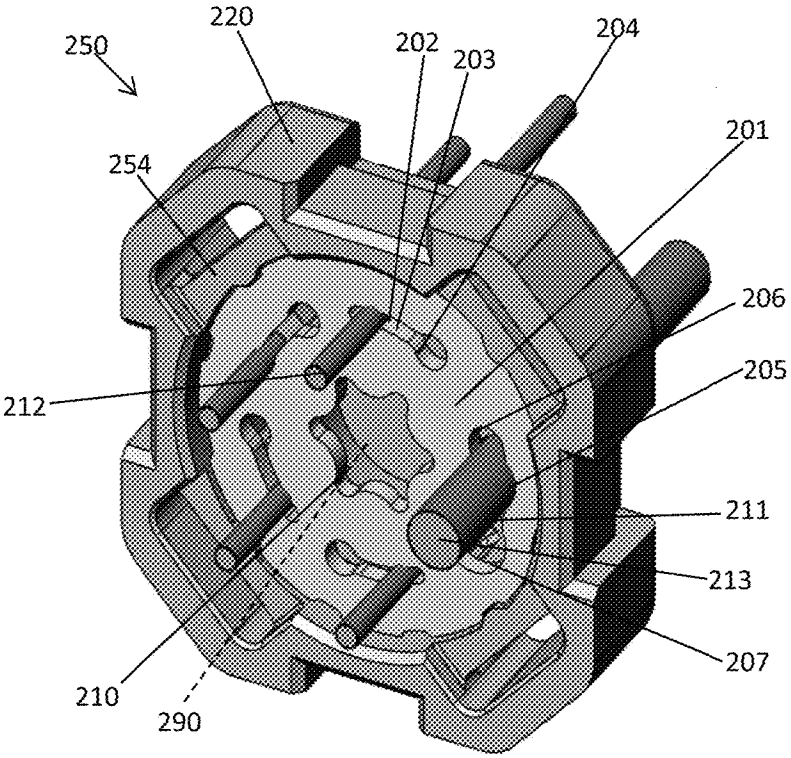
FIG. 2*b* depicts a second isometric view of an engaged rotary insulation displacement contact (IDC) junction connector without cap and with wires in accordance with an illustrative embodiment.
Figure 2A:
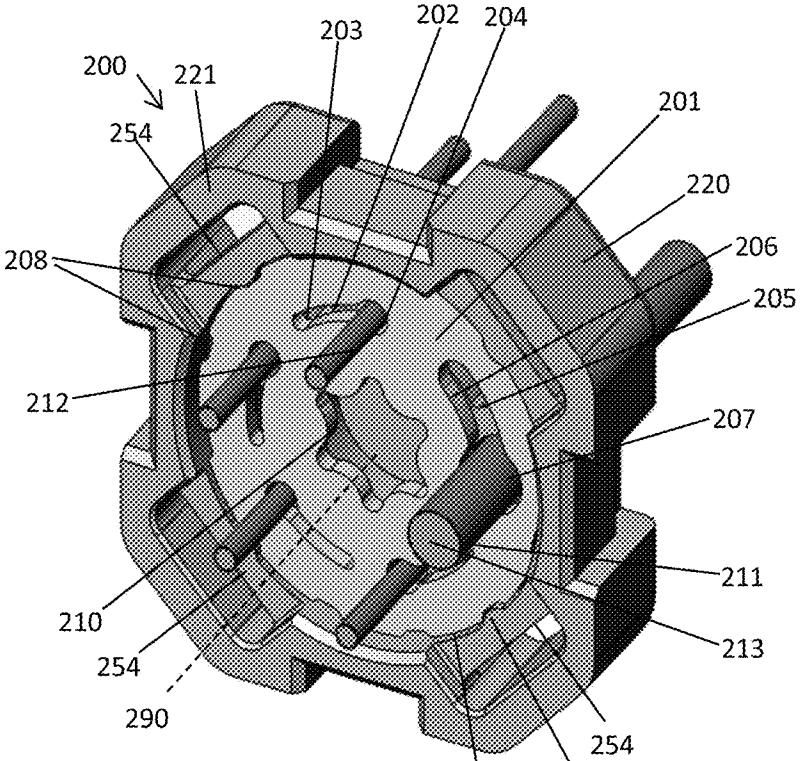
FIG. 2*a* depicts an isometric view of an unengaged rotary insulation displacement contact (IDC) junction connector without cap and with wires in accordance with an illustrative embodiment.

FIG. 2*a* depicts an isometric view of an unengaged rotary insulation displacement contact (IDC) junction connector 200 without cap and with wires in accordance with an illustrative embodiment. FIG. 2*b* depicts a second isometric view of an engaged rotary insulation displacement contact (IDC) junction connector 250 without cap and with wires in accordance with an illustrative embodiment. Generally referring to FIGS. 2*a* and 2*b*, the rotary IDC junction connector includes an insulated housing 220 and an electrical contact 201. The insulated housing includes a base 221 and a cap (removed in FIGS. 2*a* and 2*b*).

The base 221 includes a contact recess 222 and a plurality of projections 224. The plurality of projections 224 are situated around the outer edge (i.e., away from a central axis 290) of the contact recess 222 and extend toward the central axis 290. The plurality of projections 224 creates a frictional force between the base 221 and the electrical contact 201. The frictional force between the base 221 and electrical contact 201 ensures that the electrical contact 201 does not move when the electrical contact 201 is not being actuated. Further, the electrical contact 201 may include a plurality of notches 208. The plurality of notches 208 are located on the outer edges (i.e., away from the central axis 290) of the electrical contact 201. The plurality of notches 208 may be spaced apart a distance that allows for each of the plurality of projections 224 to mesh with one of the plurality of notches 208. In other embodiments, only some of the plurality of projections 224 mesh with only some of the plurality of notches 208. The meshing of the plurality of the notches 208 and the plurality of the projections 224 create predetermined and discrete positions for the electrical contact 201 within the insulated housing 220. Additionally, the meshing of the plurality of the notches 208 and the plurality of the projections 224 bolsters the frictional force between the electrical contact 201 and the insulated housing 220. The frictional force improves the reliability of the electrical connection (once the connection has been made) between the wires and the electrical contact 201. In an embodiment, the plurality of notches 208 may be larger than the plurality of projections 224 to allow for minor float (e.g., minor rotational movement without frictional resistance) in order to accept minor misalignments between the IDCs and their respective wire openings. The base 221 may also include bridges 254. In an embodiment, one of the plurality of projections 224 are located on (e.g., project from) each of the bridges 254. The bridges 254 are portions of the base 221 that are configured to flex so that the plurality of projections 224 can deflect out of a first of the plurality of notches 208 and snap into a second of the plurality of notches 208 as the electrical contact 201 is rotated from a first position to a second position.

The electrical contact 201 includes a motion-force portion 210, a first insulation displacement contact (IDC) 202, and a second insulation displacement contact (IDC) 205. In an embodiment, the electrical contact 201 may include one, two, three, four, five, six or more insulation displacement contacts. The total number of insulation displacement contacts may be dependent upon the application that the rotary IDC junction connector 200 is being used. The motion-force portion 210 is a portion of the electrical contact 201 that can be selectively engaged by a drive device or other tool that allows for the mechanical rotation of the electrical contact 201 around the central axis 290 and relative to the insulated housing 220. In alternative embodiments, the motion-force portion 210 may include a permanent tool or portion that facilitates selective mechanical rotation of the electrical contact 201.

The first IDC 202 includes a first wide portion 204 and a first narrow portion 203. The first IDC also includes at least one blade. The at least one blade may extend entirely around the inner edge of the first IDC 202. Alternatively, the at least one blade may only extend along a portion of one edge of the first narrow portion 203. The first wide portion 204 has a width wide enough to allow a first wire 212 to extend through the insulated housing 220 and through the first wide portion 204. In an embodiment, the first wide portion 204 is circular shaped with a diameter that is greater than a diameter of the first wire 212 and equal to the diameter of a corresponding wire opening of the insulated housing 220. The first narrow portion 203 has a portion where the width that is slightly less than a diameter of a conductive core of the first wire 212. The first narrow portion 203 begins at a point where the width of the first IDC 202 becomes less than the diameter of the first wire 212. In an embodiment, the first narrow portion 203 may have a consistent width as the first narrow portion 203 extends from the first wide portion 204 to a distal end. In alternative embodiments, the first narrow portion 203 has a tapered width as the first narrow portion 203 extends from the first wide portion 204 to the distal end.

The second IDC 205 includes a second wide portion 207 and a second narrow portion 206. The second IDC also includes at least one blade. The at least one blade may extend entirely around the inner edge of the second IDC 205. Alternatively, the at least one blade may only extend along a portion of one edge of the second narrow portion 206. The second wide portion 207 has a width wide enough to allow a second wire 211 to extend through a corresponding wire opening of the insulated housing 220 and through the second wide portion 207. In an embodiment, the second wide portion 207 is circular shaped with a diameter that is greater than a diameter of the second wire 211 and equal to the diameter of a corresponding wire opening of the insulated housing 220. The second narrow portion 206 begins at a point where the width of the second IDC 205 becomes less than the diameter of the second wire 211. The second narrow portion 206 has at least a portion where the width that is slightly less than a diameter of a conductive core 213 of the second wire 211. In an embodiment, the second narrow portion 206 may have a consistent width as the second narrow portion 206 extends from the second wide portion 207 to a distal end. In alternative embodiments, the second narrow portion 206 has a tapered width as the second narrow portion 206 extends from the second wide portion 207 to the distal end. In alternative embodiments, the first and second IDC's 202 and 205 (and all other DC's) may be of any shape or type that allows for the insulation of corresponding wires to be displaced and an electrical connection to be created between the electrical contact 201 and wires when the electrical contact 201 is rotated within the insulated housing.

Referring generally now to FIG. 2*a*, the first wire 212 has been inserted through the first wide portion 204 and through a corresponding wire opening of the insulated housing 220. The second wire 211 has been inserted through the second wide portion 207 and through a second corresponding wire opening of the insulated housing 220. In FIG. 2*a* there is no electrical connection between the electrical contact 201 and the first and second wires 211 and 212. Referring generally now to FIG. 2*b*, the electrical contact 201 has been engaged by a driver and rotated along the central axis 290 in order to force the first and second wires 212 and 211 into respective narrow portions 203 and 206. During the rotation of the electrical contact 201, the corresponding wire openings of the insulated housing 220 provide a normal force to each respective wire 211 and 212 and ensure that there is no movement of the wires 211 and 212 relative to the insulated housing 220. The rotation of the electrical contact 201 caused the at least one blade of the first IDC 202 to displace the insulation of the first wire 212 and thereby create a mechanical and electrical connection between the electrical contact 201 and the first wire 212. Similarly, the rotation of the electrical contact 201 caused the at least one blade of the second IDC 205 to displace the insulation of the second wire 211 and thereby create a mechanical and electrical connection between the electrical contact 201 and the second wire 211. In this way, the first wire 212, the second wire 211, and the electrical contact 201 are all electrically and mechanically connected. As stated above, in alternative embodiments, the rotary IDC junction connectors 200 or 250 are not limited by the number of wire positions or number of IDCs. Additionally, each IDC may be of any shape, size, or type that allows for the insulation displacement of corresponding wires. That is, the rotary IDC junction connector 200 or 250 may have a plurality of IDC's and corresponding wire openings each designed for a different gauge of wire.

Figure 3B:
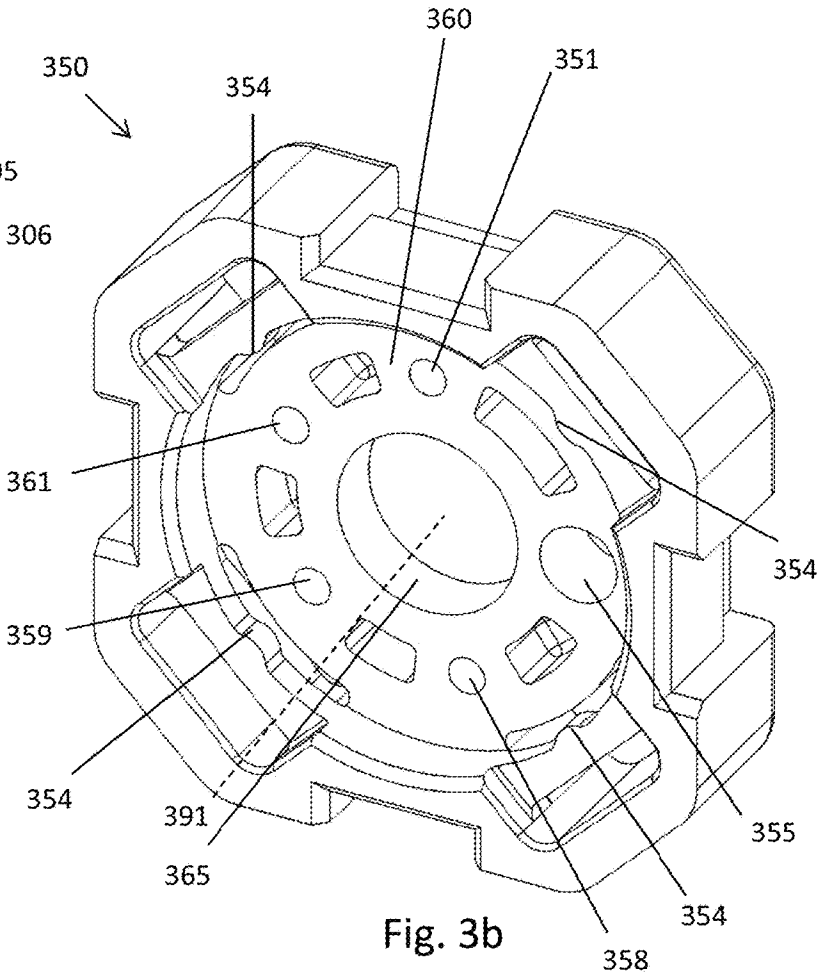
FIG. 3*b* depicts an isometric view of a base of an insulated housing in accordance with an illustrative embodiment.
Figure 3A:
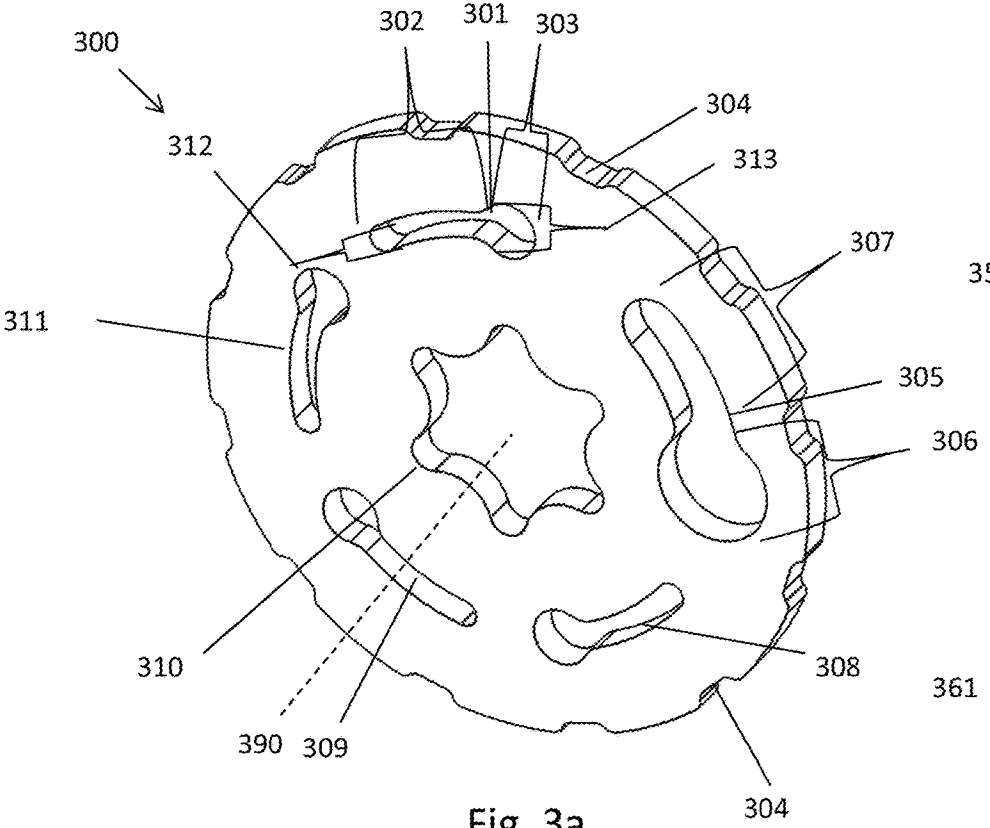
FIG. 3*a* depicts an isometric view of an electrical contact in accordance with an illustrative embodiment.

FIG. 3 depicts an isometric view of an electrical contact 300 in accordance with an illustrative embodiment. The electrical contact 300 includes a motion-force portion 310, a first insulation displacement contact (IDC) 301, and a second insulation displacement contact (IDC) 305. In an embodiment, the electrical contact 300 may also include other insulation displacement contacts (IDCs) 308, 309, and 311. In alternative embodiments, the electrical contact 300 may include one, two, three, four, five, six or more IDCs and each IDC may be sized uniquely to a specific gauge of wire. That is, the electrical contact 300 is not limited by a number of IDCs, position of each IDC, or size of each IDC.

The first IDC 301 includes a first wide portion 303 and a first narrow portion 302. The first IDC also includes at least one blade. The at least one blade may be located on an inner edge of the first narrow portion 302 and extend the entire length of the first narrow portion 302. Alternatively, the at least one blade may be positioned anywhere on the inner edge of the first IDC 301 that allows for the displacement of insulation on a corresponding wire when the corresponding wire enters the first narrow portion 302. In an embodiment, in general, the first IDC 301 and the second IDC 305 are apertures with an elongated and curved shape. The curved shape may have a center of curvature at a central axis 380. The first wide portion 303 has a width 313 that is greater than or equal to a diameter of a corresponding wire. In some embodiments, the width 313 is also greater than or equal to the diameter of a corresponding wire opening of an insulated housing. The first narrow portion 302 has a width 312 that is less than the diameter of the corresponding wire and less than a diameter of a corresponding wire opening. Specifically, the first narrow portion 302 has at least a portion where the width 312 is less than a diameter of the conductive core of the corresponding wire.

Similarly, the second IDC 305 includes a second wide portion 306, a second narrow portion 307, and at least one blade. The at least one blade may be located on an inner edge of the second narrow portion 307 and extend the entire length of the second narrow portion 307. In other embodiments, the at least one blade may be positioned anywhere on the inner edges of the second IDC 305 that allows for the displacement of insulation on a corresponding wire when the second narrow portion 307 engages with the corresponding wire. The second wide portion 306 has a width that is greater than or equal to a diameter of a second corresponding wire. In some embodiments, the width is also greater than or equal to the diameter of a second corresponding wire opening of an insulated housing. The second narrow portion 307 has a width that is less than the diameter of the second corresponding wire. Specifically, the second narrow portion 307 has at least a portion where the width is less than a diameter of the conductive core of the second corresponding wire.

The electrical contact 300 may also include a plurality of notches 304. The plurality of notches may be located on the outer edge (e.g., the edge furthest away from the central axis 390). In an embodiment, the plurality of notches 304 are spaced a distance apart that allows for a corresponding projection of an insulated housing and to hold the electrical contact (via a frictional force) in a first position. The first position may be a position where the first wide portion 303 and the second wide portion 306 are aligned with corresponding wire openings of the insulated housing. After the electrical contact 300 is rotated within the insulated housing, each of the corresponding projections mesh with a different one of the plurality of notches 304 to hold the electrical contact (via a frictional force) in a second position. The second position may be a position where the first narrow portion 302 and the second narrow portion 307 are aligned with respective corresponding wire openings of the insulated housing. That is, in the second position, the electrical contact 300 is held in place (e.g., at the pre-determined location of the second position) to ensure that any electrical and mechanical connection between corresponding wires and the electrical contact 300 that was created during the rotation of the electrical contact 300 is maintained. In other words, the plurality of notches 304 are positioned to mesh with corresponding projections in order to create pre-determined positions of the electrical contact 300 relative to the corresponding insulated housing. The pre-determined positions create an easy-to-use and reliable rotary insulation displacement contact junction connector.

The motion-force portion 310 may be a tool aperture (e.g., opening) centered on the central axis 390. The tool aperture may be shaped to receive a corresponding driver head of a driver bit. The driver head may be of any type that is known within the art. For example, the driver may be a Torx®, Allen®, Phillips, Slot, Square, or any other driver type. The tool aperture is shaped such that the driver head engages with the electrical contact 300 and can create a mechanical connection between the electrical contact 300 and the driver bit in order to rotate the electrical contact 300 when the driver bit is rotated. In alternative embodiments, the motion-force portion 310 may be a portion of the electrical contact 300 that can be grabbed by user in order to rotate the electrical contact 300 within a corresponding housing. In other embodiments, the motion-force portion 310 may be a knob or lever that is permanently affixed to the electrical contact 300 that can be grabbed by a user in order to rotate the electrical contact 300 within the insulated housing.

FIG. 3*b* depicts an isometric view of a base of an insulated housing 350 in accordance with an illustrative embodiment. The insulated housing 350 includes a contact recess 360, a plurality of wire openings 351, 355, 358, 359, and 361, a plurality of projections 354, and a tool recess 365. The tool recess 365 exposes the motion-force portion 310 of the electrical contact 300 and allows for a tool to engage with and rotate the electric contact 300 within the base of the insulated housing 350. The plurality of projections 354 extend from edge of the contact recess 360 furthest away from the tool recess 365 toward the tool recess 365. The plurality of projections 354 creates a frictional force between the base of the insulated housing 350 and a corresponding electrical contact. In an embodiment, there are four projections 354 each located radially symmetric about a central axis 391. In alternative embodiments, there may be more or less of the plurality of projections 354.

In an embodiment, the insulated housing 350 may include more or fewer of the wire openings 351, 355, 358, 359, and 361. That is, in different applications and embodiments, the insulated housing 350 has any number of wire openings 351, 355, 358, 359, and 361 that may each be sized differently to receive a particular gauge of wire. In an embodiment, the number of IDCs 301, 305, 308, 309, and 311 of the electrical contact 300 is equal to the number of wire openings 351, 355, 358, 359, and 361. Similarly, the each of the IDC 301, 305, 308, 309, and 311 is positioned to align with corresponding wire openings 351, 355, 358, 359, and 361. That is, when the electrical contact 300 is placed in a first position within the base of the insulated housing 350, all of the wide portions of the IDCs 301, 305, 308, 309, and 311 are aligned with corresponding wire openings 351, 355, 358, 359, and 361 so that corresponding wires can be inserted through each of the wire openings 351, 355, 358, 359, and 361 and corresponding IDCs 301, 305, 308, 309, and 311. As stated above, the electrical contact 300 and the base of the insulated housing 350 are not limited by the number of IDCs or the number of wire openings. For example, in alternative embodiments, there may be one, two, three, four, five, six or more IDCs and wire openings.

Figure 4:
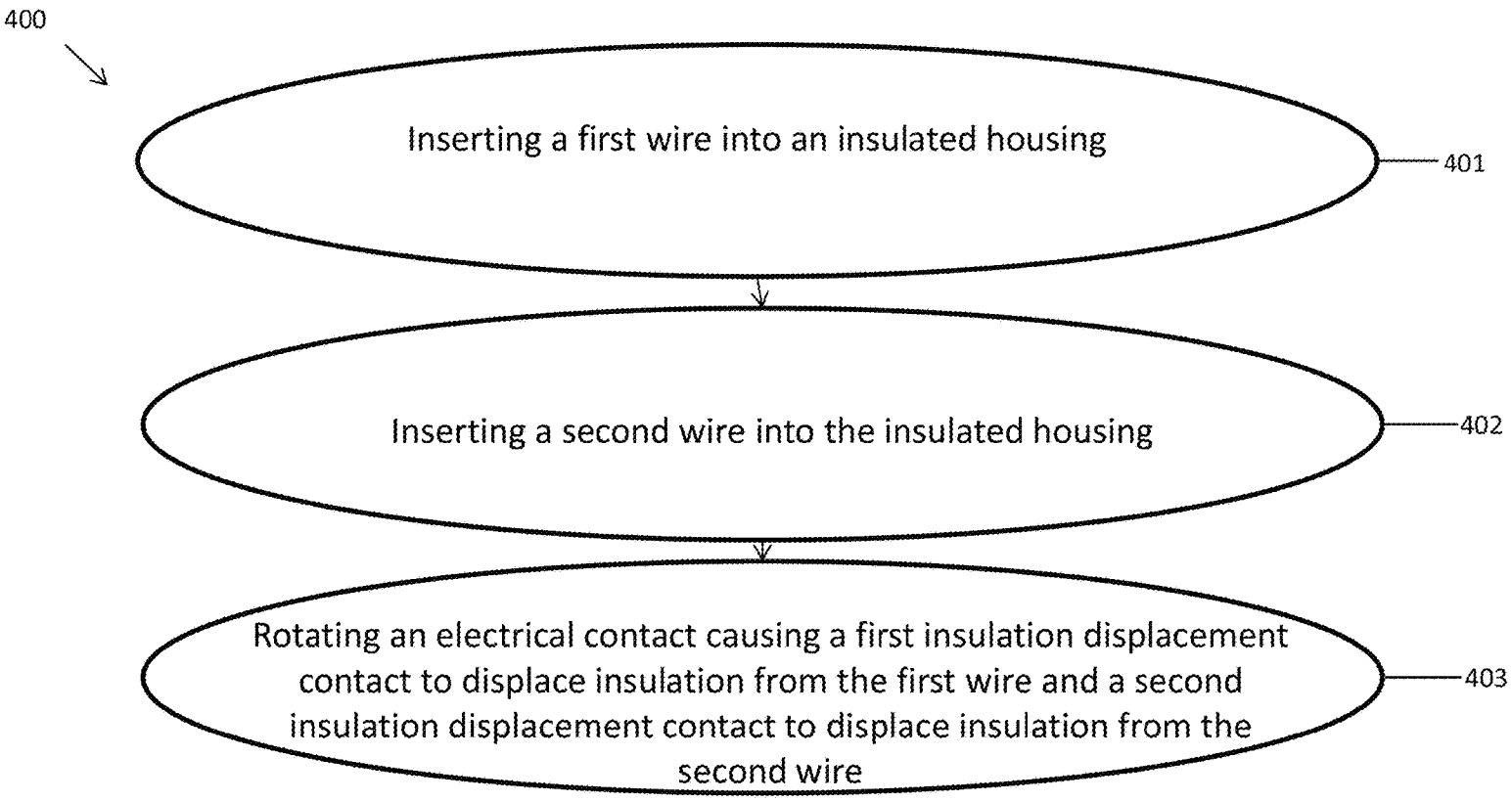
FIG. 4 depicts a flow diagram for a method of use of a rotary insulation displacement contact (IDC) junction connector in accordance with an illustrative embodiment.

FIG. 4 depicts a flow diagram for a method of use 400 of a rotary insulation displacement contact junction connector in accordance with an illustrative embodiment. In an operation 401, a first wire is inserted into a wire opening of an insulated housing. The first wire extends through the wire opening and a wide portion of an insulation displacement contact of an electrical contact. In an embodiment, the first wire extends entirely through the insulated housing. In alternative embodiments, the first wire does not extend entirely through the insulated housing. In an operation 402, a second wire is inserted into a second wire opening of the insulated housing. The second wire extends through the second wire opening and a wide portion of a second insulation displacement contact of an electrical contact. Similar to the first wire, the second wire may or may not extend entirely through the insulated housing. In an embodiment, there may be any number of wires inserted into corresponding wire openings and insulation displacement contacts. The gauge of each wire (and corresponding width and diameter of each IDC and wire opening) may be unique to each application.

In an operation 403, the electrical contact is rotated causing a first insulation displacement contact to displace insulation from the first wire and a second insulation displacement contact to displace insulation from the second wire to create a mechanical and electrical connection between the first wire, second wire, and electrical contact. Specifically, the rotation of the electrical contact relative to the insulated housing causes the first and second wires to enter the narrow portion of their corresponding insulation displacement contacts. In an embodiment, a single blade positioned in each of the insulation displacement contacts causes the insulation of each wire to be displaced and the blade to make a mechanical and electrical connection with the conductive core of the wire. In alternative embodiments, each IDC may be of any design that allows for the displacement of insulation from each wire when the electrical contact is rotated relative the insulated housing. The electrical contact may be rotated by any means. In an embodiment, the electrical contact includes a motion-force portion that can be engaged by a driver bit and mechanically rotated. The driver bit may be connected to an electric drill or may be connected to a handle. In alternative embodiments, the motion-force portion may be a portion of the electrical contact. In yet other embodiments, the motion-force portion may be engaged and selectively rotated by a portion of the insulated housing.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A system comprising: an insulated housing comprising at least one wire opening; and an electrical contact comprising: at least one insulation displacement contact, wherein at least a portion of the at least one insulation displacement contact is aligned with the at least one wire opening; a motion-force portion configured to facilitate rotation of the electrical contact within the insulated housing and relative to the insulated housing around a central axis; and a plurality notches on an outer edge of the electrical contact, wherein the insulated housing further comprises a plurality of projections, and wherein each of the plurality of projections is configured to engage one of the plurality of notches; a first position, wherein the first position comprises the plurality of projections engaged with first respective ones of the plurality of notches and the at least one wire opening aligned with a wide portion of the at least one insulation displacement contact; and a second position, wherein the second position comprises the plurality of projections engaged with second respective ones of the plurality of notches and the at least one wire opening aligned with a narrow portion of the at least one insulation displacement contact, wherein the second respective ones of the plurality of notches are different from the first respective ones of the plurality of notches.

2. The system of claim 1, wherein the at least one wire opening extends entirely through the insulated housing.

3. The system of claim 1, wherein the at least one insulation displacement contact comprises a narrow portion, a wide portion, and at least one blade portion extending between the narrow portion and the wide portion.

4. The system of claim 3, wherein the wide portion has a width equal to or greater than a diameter of the at least one wire opening.

5. The system of claim 3, wherein the narrow portion has a width smaller than a diameter of the at least one wire opening.

6. The system of claim 3, wherein the at least one blade extends an entire length of the at least one insulation displacement contact from the wide portion to the narrow portion.

7. The system of claim 1, wherein the insulation displacement contact comprises an elongated aperture.

8. The system of claim 7, wherein the elongated aperture is curved and has a center of curvature at the central axis.

9. The system of claim 1, wherein the motion-force portion comprises an opening centered on the central axis, and wherein the opening is shaped to receive a driver bit.

10. The system of claim 1, the insulated housing further comprising a second wire opening;

the electrical contact further comprising a second insulation displacement contact, the second insulation displacement contact comprising a second narrow portion, a second wide portion, and at least one second blade;

wherein at least a portion of second insulation displacement contact is aligned with the second wire opening.

11. The system of claim 10, wherein the second wide portion has a width equal to a diameter of the at least one wire opening.

12. The system of claim 10, wherein the second narrow portion has a width less than a diameter of the at least one wire opening.

13. A method of connecting a first wire and a second wire, the method comprising: inserting the first wire into a first wire opening of an insulated housing and through a wide portion of a first insulation displacement contact of an electrical contact, wherein the electrical contact comprises a plurality notches on an outer edge, wherein the insulated housing comprises a plurality of projections, and wherein each of the plurality of projections is configured to engage one of the plurality of notches; inserting the second wire into a second wire opening of the insulated housing and through a second wide portion of a second insulation displacement contact of the electrical contact; and rotating the electrical contact about a central axis to form an electrical connection between the first and second wires and the electrical contact, wherein rotating the electrical contact is performed by applying a rotational force to a motion-force portion of the electrical contact at the central axis, wherein rotating the electrical contact comprises rotating the electrical contact from a first position to a second position, wherein the first position comprises the plurality of projections engaged with first respective ones of the plurality of notches and the at least one wire opening aligned with a wide portion of the at least one insulation displacement contact, and wherein the second position comprises the plurality of projections engaged with second respective ones of the plurality of notches and the at least one wire opening aligned with a narrow portion of the at least one insulation displacement contact, wherein the second respective ones of the plurality of notches are different from the first respective ones of the plurality of notches.

14. The method of claim 13, wherein the rotating of the electrical contact causes the first insulation displacement contact to displace insulation of the first wire and an electrical and mechanical connection to be created between a conductive core of the first wire and the electrical contact.

15. The method of claim 14, wherein the rotating of the electrical contact further causes the second insulation displacement contact to displace insulation of the second wire and an electrical and mechanical connection to be created between a conductive core of the second wire and the electrical contact.

16. The method of claim 13, wherein the inserting the first wire further comprises extending the first wire entirely through the insulation housing.

17. The method of claim 13, wherein the rotation of the electrical contact comprises inserting a driver bit into a central tool receiving portion of the electrical contact.

18. The method of claim 13, further comprising inserting a third wire into a third wire opening of an insulated housing and through a wide portion of a third insulation displacement contact of the electrical contact.

* * * * *